US010787334B2

(12) United States Patent
Downs

(10) Patent No.: US 10,787,334 B2
(45) Date of Patent: Sep. 29, 2020

(54) ABOVE-GROUND POOL ASSEMBLY APPARATUS

(71) Applicant: Larry Downs, Fairmount, IN (US)

(72) Inventor: Larry Downs, Fairmount, IN (US)

( * ) Notice: Subject to any disclaimer, the term of this patent is extended or adjusted under 35 U.S.C. 154(b) by 0 days.

(21) Appl. No.: 16/283,722

(22) Filed: Feb. 22, 2019

(65) Prior Publication Data

US 2019/0256313 A1 Aug. 22, 2019

Related U.S. Application Data

(60) Provisional application No. 62/633,792, filed on Feb. 22, 2018.

(51) Int. Cl.

| | |
|---|---|
| ***B65H 16/04*** | (2006.01) |
| ***E04H 4/00*** | (2006.01) |
| *E04H 4/14* | (2006.01) |

(52) U.S. Cl.

CPC ..... *B65H 16/04* (2013.01); *E04H 4/0043* (2013.01); *B65H 2301/3113* (2013.01); *B65H 2301/321* (2013.01); *B65H 2401/244* (2013.01); *B65H 2405/312* (2013.01); *E04H 2004/147* (2013.01)

(58) Field of Classification Search

CPC ..... B65H 16/04; B65H 2301/3113; B65H 2301/321; B65H 2401/244; B65H 2405/312; B65H 49/28; E04H 4/0043; E04H 2004/147

See application file for complete search history.

(56) References Cited

U.S. PATENT DOCUMENTS

| | | | | |
|---|---|---|---|---|
| 4,006,865 | A * | 2/1977 | Howard | B65H 49/305 242/388.7 |
| 4,602,753 | A * | 7/1986 | Kosch | B65H 59/04 242/128 |
| 4,681,277 | A * | 7/1987 | Kosch | B23K 9/1333 242/128 |
| 4,953,810 | A * | 9/1990 | Stadig | B65H 49/28 242/129 |
| 8,702,030 | B1 * | 4/2014 | Gilham, Jr. | E04H 4/14 242/405 |
| 9,394,744 | B2 | 7/2016 | Leung | |
| 2003/0080236 | A1 * | 5/2003 | Armstrong | E04H 17/266 242/557 |
| 2011/0108658 | A1 * | 5/2011 | Factor | B65H 49/32 242/594 |
| 2017/0144685 | A1 * | 5/2017 | McVay | B65H 75/22 |

* cited by examiner

*Primary Examiner* — Michael E Gallion

(74) *Attorney, Agent, or Firm* — Scott Houtteman; Houtteman Law, LLC

(57) ABSTRACT

An above-ground pool wall assembly apparatus is disclosed which allows the single handed mounting of the pool wall along the pool wall bottom rail. The rolled up pool wall is mounted on a turntable and kept upright by a plurality of retainer posts. As the wall is unreeled a series of guide posts help separate the unreeled portion of the wall from the roll and guide the wall into position on the bottom rail. As the pool wall is progressively mounted along the bottom rail, the apparatus can be kept in the proper position by wheeling the apparatus around the bottom rail in coordination with the progress of the installation.

12 Claims, 2 Drawing Sheets

ABOVE-GROUND POOL ASSEMBLY APPARATUS

This application claims benefit to U.S. Provisional Application No. 62/633,792, filed Feb. 22, 2018, the contents of which are hereby incorporated by reference.

BACKGROUND

Generally speaking, above ground pools have certain advantages over below ground pools. They are relatively cheaper and easier to assemble and dissemble. There remains, however, one vexing inconvenience associated with above ground pool installation, three (3) or more people are required. Above ground pools feature a wall, typically made of galvanized steel, from 30 inches to 54 inches tall. It is typically delivered to the construction site in a tightly wound roll. The wall is typically inserted into a bottom rail (also called a wall channel or bottom track). To install the wall, one person holds the roll in place, another inserts the unreeled portion of the wall into the bottom rail and, as the wall is further unreeled, others hold the unreeled portions of wall in place in the base.

This disclosed apparatus allows a single person to perform all of the above actions and thus singly handedly assemble an above ground pool.

DETAILED DESCRIPTION

Figure 1:
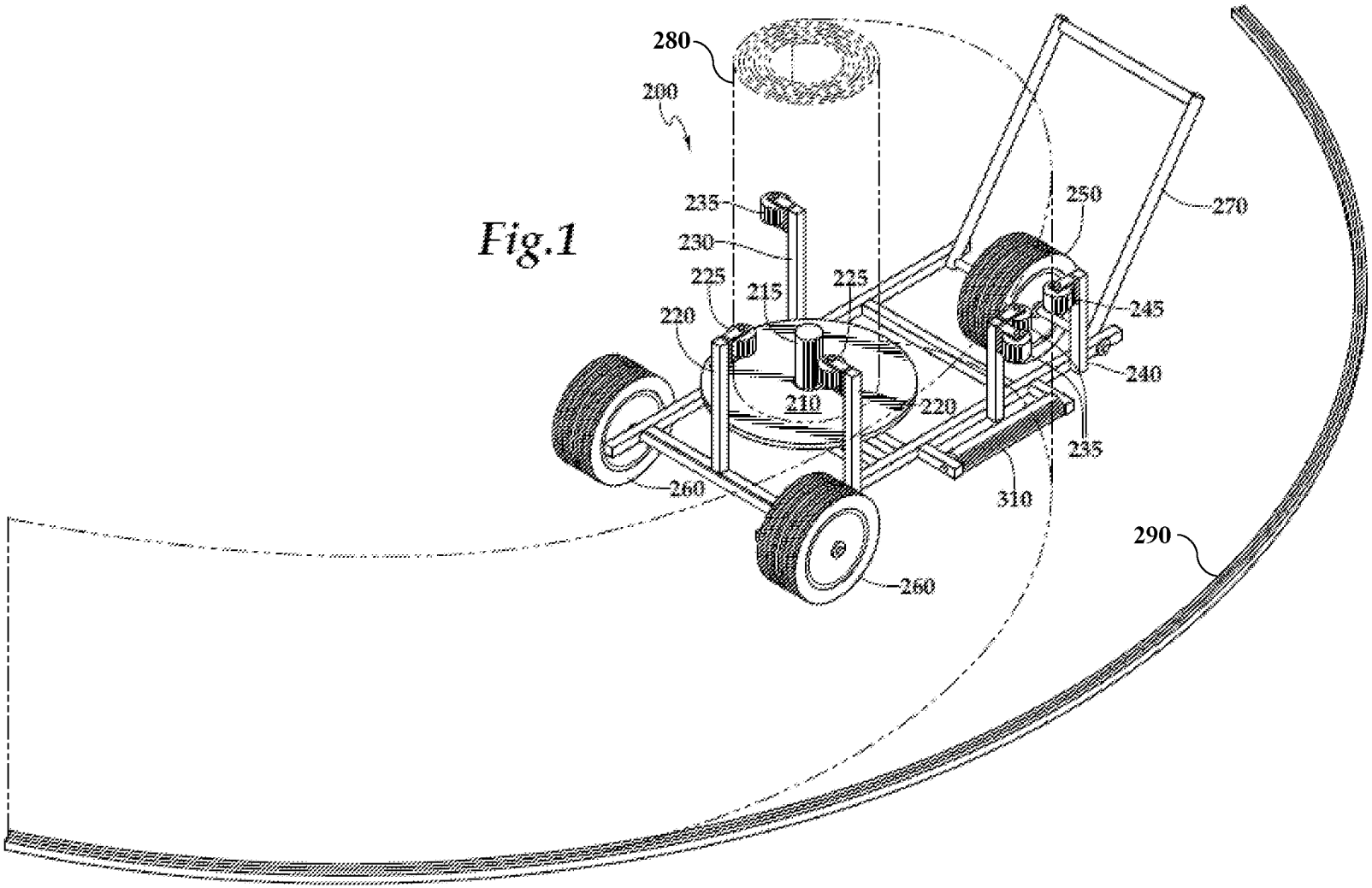
FIG. 1 is a view of the apparatus in use.

FIG. 1 illustrates the apparatus, with a pool wall roll 280 mounted and in the middle of a pool wall installation process. In order to allow the single-handed installation of an above ground pool wall the apparatus contains several features.

Figure 2:
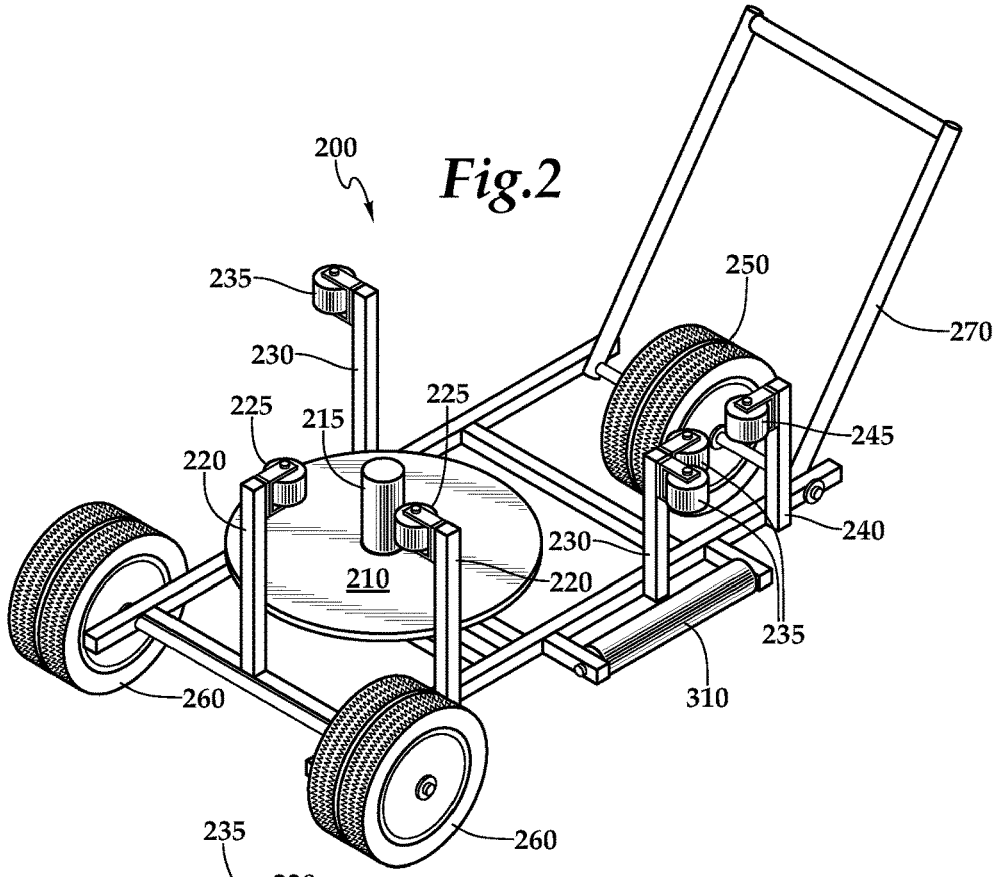
FIG. 2 is an axiomatic view of the apparatus.
Figure 5:
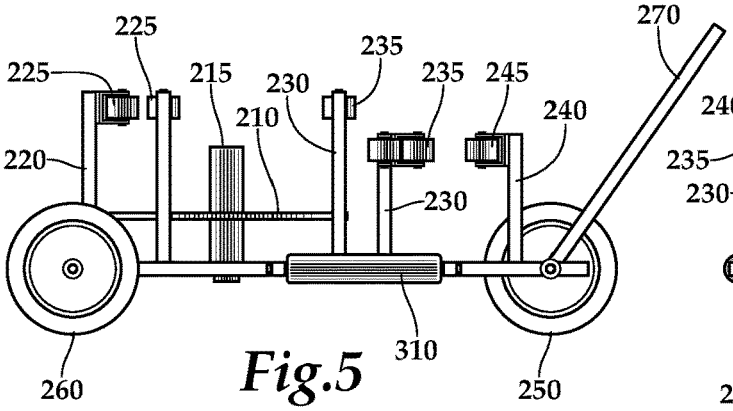
FIG. 5 is a right side view of the apparatus
Figure 4:
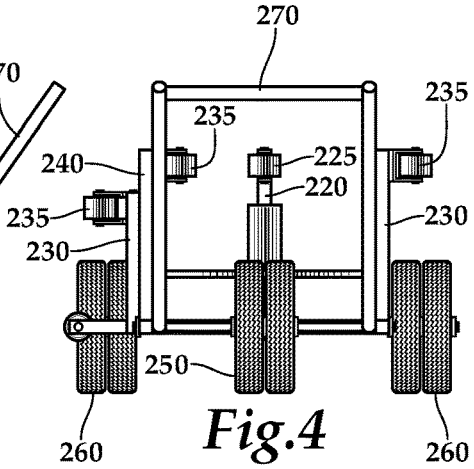
FIG. 4 is a front view of the apparatus

With reference to FIGS. 2 and 5, a turntable 210, is provided that is configures to hold the pool wall roll, as it is typically provided from the manufacturer. Optionally a dowel 215 can be provided at the central axis of the turntable to keep the pool wall roll 280 in place in the center of the turntable. The turn table 210 has a diameter large enough to hold the rolled up pool wall, preferable about 18 inches.

A plurality of retainer or support posts 220 are present just outside the perimeter of the turntable which are configured to both (1) keep the pool wall roll 280 from falling out of its upright position on the turntable and (2) allow the pool wall roll 280 to rotate as the end portion of the wall is unreeled from the roll.

Figure 3:
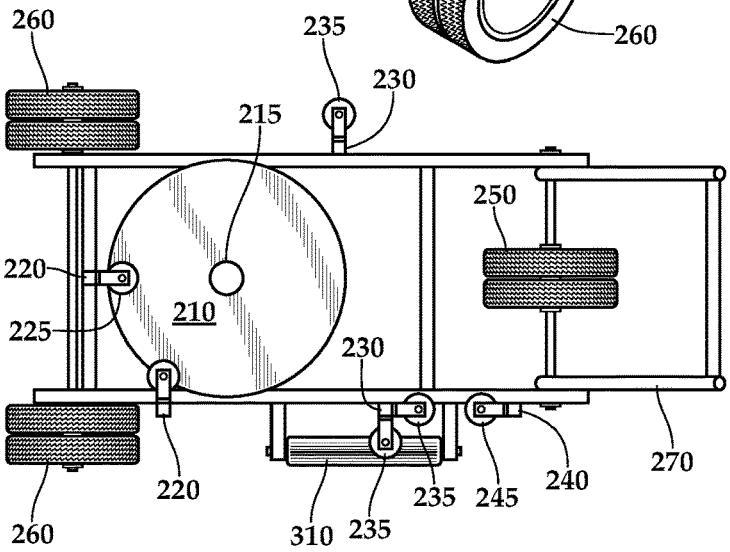
FIG. 3 is a top view of the apparatus

The retainer posts will preferable have a low friction or friction free inner surface that contacts the roll outer surface but allows the roll to rotate on the turntable. (Note, for the purposes of this invention "low friction" or "friction free" surfaces are interchangeable and provide the same function.) While any low friction device or surface will function, typically, the support posts will have rollers 225 mounted and facing inward to contact the roll outer surface. In a preferred embodiment the apparatus has two retainer posts with rollers facing inward. In another preferred embodiment the two retainer posts are positioned as illustrated in FIG. 3 around the perimeter of the turntable at about 10 o'clock 220 and 12 o'clock 220.

In addition to retainer posts, the apparatus has a plurality of guide posts 230 are deployed on the apparatus to guide the portion of the wall that is unreeling from the roll. These posts also have low friction surfaces 235 but, in contrast to the retainer posts, the guide post low friction surfaces face outward where they contact the inner surface of the unreeled portion of the pool wall. These posts also help keep the pool wall roll 280 from falling, not only because of their support but also the low friction surface allows the installer to pull on the unreeled portion of the wall, and further unreel the wall from the roll, without excessive force. The low friction surfaces of the guide posts are preferably rollers 235, as was the case with the retainer posts 220.

In a preferred embodiment, a first guide post 235 is positioned more or less on the opposite side of the turntable from the first 220 of two retainer posts. Note in FIG. 3, again, the first retainer post 220 at 10 o'clock and the first guide post 235 at about 4 o'clock. The first guide post 235 is spaced further away from the perimeter of the turntable than the retainer posts 220. A second guide post 235 is positioned at about 7 or 8 o'clock and is spaced still further from the perimeter of the turntable. This tracks the natural path of the wall as it is further unreeled from the roll.

Also, because this portion of the wall naturally curls around the perimeter of the roll there are, in still another preferred embodiment, a guide post with two low friction surfaces 235 facing outward, and spaced ninety degrees apart, so that the wall will not encounter friction no matter which portion of this guide post the wall contacts. Again, the preferred low friction surfaces are rollers 235.

In still another embodiment, the apparatus can feature additional low friction surfaces between which the wall is unreeled. Again, a preferred solution is to install rollers so that they contact both inner and outer sides of the unreeled portion of the wall and keep it in a vertical orientation during installation. A specific further embodiment is to add another inward facing exit post 240 to contact the portion of the wall unreeled from the roll and opposite an outward facing guide post 230. This additional post will help direct the unreeled portion of the wall toward the proper position as it is inserted into the bottom rail 290.

In still another preferred embodiment, the apparatus features a horizontally orientated low friction surface 310 were the bottom edge of an unreeled portion of the wall exits the apparatus on its way to installation in the bottom rail 290. This additional surface will insure that the wall can be installed without the bottom edge scraping against a surface of the apparatus. A preferred low friction surface is a roller.

The apparatus functions as follows. First, the rolled up pool wall is placed vertically on a turntable 210 located on the upper surface of an apparatus 200. The turntable will turn around a central axis. Typically, the central axis will be mounted in the frame of the apparatus and rise up about 8.75 inches above the frame. The turntable will be located at about the midpoint of the axis.

Two retainer post rollers contact the outer perimeter of the wall roll while the leading edge of the wall exits the turntable in between the second roller and a third roller on the first guide post. As the leading edge of the wall exits the turntable, the third roller contacts the inner surface of the unreeled portion of the wall. Thus, the three rollers acting together guide the unreeling of the wall while at all times holding the rolled up wall in a vertical position.

In some embodiments, the unreeled portion of the wall is threaded in between the guide post 230 and an additional post 240.

As the unreeled portion of the wall exits the apparatus it contacts a horizontally orientated roller 310 so that the bottom edge of the wall does not scrape against the frame of the apparatus.

Importantly, at all times during the unreeling of the pool wall roll 280, the installer can release his hold of the apparatus and the pool wall roll 280 and the pool wall roll will remain in place, that is, the roll will not fall over. This allows the installer to shift his position as need be, to insert the bottom edge of the wall into the bottom rail 290 or to move the apparatus further along the bottom rail 290 as installation progresses along the length of the bottom rail 290. This enables a single person to do the work that previously required three (3) or more people.

During installation, the leading edge of the wall is inserted into the bottom track of the pool. Typically, some sort of retention spike is used to hold the edge of the wall in place in the track. For example, a long rigid bar can be pounded vertically into the ground alongside of the leading edge of the wall and attached to the wall to keep the wall in place. The attachment can be as simple as a bend at the top of the retention spike that causes the top of the spike to bend over the top of the wall to hold the wall top in place and thus keep the wall from falling over. Also, at this point, a section of the pool top ledge can be installed on the top edge of the wall.

In certain embodiments an additional low friction surface is present on the upper edge of the apparatus base, just below the wall lower edge, at the point where the wall leaves the apparatus turntable. This will ease installation by eliminating friction (or scraping) between the wall lower edge and the apparatus frame. Again, any low friction surface will function, however, a preferred surface is another roller underneath the bottom edge of the wall, located at the point in which the wall leaves the apparatus frame.

The apparatus can have wheels 250, 260 and a handle that allow the cart to be pulled around the circumference of the pool as the wall is unrolled from the apparatus. In a preferred embodiment, the apparatus has two back wheels 260 and a single front wheel 250. Typically, the back wheels will be spaced apart approximately 19 inches and the distance from the front wheel axle to the back wheel axle will be about 36 inches.

The handle, in a preferred embodiment, will be attached to the front wheel axle and raise up to a height of about 24 to 25 inches above the ground, preferably 24.27 inches.

The process is repeated as the apparatus is moved around the path of the bottom track of the pool.

What is claimed is:

1. An apparatus useful for single handed assembly of an above ground pool comprising:

a turntable suitable for holding a pool wall roll, a plurality of retainer posts deployed on the apparatus around a perimeter of the turntable having low friction surfaces facing inward and configured to hold the pool wall roll in an upright position, one or more guide posts mounted on the apparatus inside a path of a portion of the pool wall roll that is unreeled from the pool wall roll and having low friction surfaces facing outward to contact an inner surface of the unreeled portion of the pool wall roll, a plurality of wheels that allow the apparatus to be repositioned along a path of an above ground pool wall bottom rail as the pool wall roll is inserted into the pool wall bottom rail;

wherein said apparatus retainer posts hold the pool wall roll upright while the guide posts direct the unreeled portion of the pool wall roll off of the turntable, said unreeled portion of the pool wall roll being in the proper position to be inserted into the pool wall bottom rail such that the assembly of the above ground pool can be carried out single handedly.

2. The apparatus useful for single handed assembly of an above ground pool as defined in claim 1, wherein said plurality of retainer posts further comprises two retainer posts.

3. The apparatus useful for single handed assembly of an above ground pool as defined in claim 2, wherein said two retainer posts are located relative to the turntable at substantially 10 o'clock and 12 o'clock, where 12 o'clock is defined as a portion of the turntable facing a rear of the apparatus.

4. The apparatus useful for single handed assembly of an above ground pool as defined in claim 2, wherein the one or more guide posts further comprises one guide post.

5. The apparatus useful for single handed assembly of an above ground pool as defined in claim 2, wherein the one or more guide posts further comprises two guide posts.

6. The apparatus useful for single handed assembly of an above ground pool as defined in claim 3, wherein the one or more guide posts further comprises two guide posts which are positioned at substantially 4 o'clock and between 7 and 8 o'clock.

7. The apparatus useful for single handed assembly of an above ground pool as defined in claim 6, further comprising an exit post located adjacent to the guide post at 7 to 8 o'clock and configured such that the unreeled portion of the pool wall roll with tread in between the exit post and the adjacent guide post and wherein said exit post further comprises an inward facing low friction surface opposite the outward facing low friction surface on the adjacent guide post.

8. The apparatus useful for single handed assembly of an above ground pool as defined in claim 7 wherein said guide post at 7 to 8 o'clock low friction surface further comprises two low friction surfaces, the first surface facing the exit post and the second surface spaced about ninety degrees from the first and facing the side of the apparatus.

9. The apparatus useful for single handed assembly of an above ground pool as defined in claim 1 further comprising a horizontally orientated low friction surface mounted on the apparatus at a point where the unreeled portion of the wall exits the apparatus.

10. The apparatus useful for single handed assembly of an above ground pool as defined in claim 1 wherein said plurality of wheels further comprises two wheels at the apparatus rear and one wheel at the apparatus front.

11. The apparatus useful for single handed assembly of an above ground pool as defined in claim 1 further comprising a handle mounted on the apparatus front configures so that an installer can pull the apparatus along as the pool wall roll is installed progressively in the pool wall roll bottom rail.

12. The apparatus useful for single handed assembly of an above ground pool as defined in claim 1 wherein said low friction surfaces further comprise rollers.

* * * * *